United States Patent [19]

Häfele et al.

[11] Patent Number: 4,842,497

[45] Date of Patent: Jun. 27, 1989

[54] FUEL INJECTION PUMP FOR INTERNAL COMBUSTION ENGINES

[75] Inventors: Walter Häfele, Fellbach; Manfred Krämer, Schwieberdingen; Johann Warga, Bietigheim-Bissingen, all of Fed. Rep. of Germany

[73] Assignee: Robert Bosch GmbH, Stuttgart, Fed. Rep. of Germany

[21] Appl. No.: 130,232

[22] PCT Filed: Mar. 19, 1987

[86] PCT No.: PCT/DE87/00116

§ 371 Date: Oct. 13, 1987

§ 102(e) Date: Oct. 13, 1987

[87] PCT Pub. No.: WO87/05664

PCT Pub. Date: Sep. 24, 1987

[30] Foreign Application Priority Data

Mar. 22, 1986 [DE] Fed. Rep. of Germany ..... 3609760
Sep. 10, 1986 [DE] Fed. Rep. of Germany ..... 3630799

[51] Int. Cl.[4] ..... F02M 59/24; F02M 59/44
[52] U.S. Cl. ..... 417/499; 123/495
[58] Field of Search ..... 417/499, 494; 123/495, 123/500, 501, 503

[56] References Cited

U.S. PATENT DOCUMENTS 2,110,314 3/1938 Wisner ..... 417/494
3,385,221 5/1968 Parks ..... 123/372
4,576,130 3/1986 Hafele et al. ..... 123/372

FOREIGN PATENT DOCUMENTS 2042629 9/1980 United Kingdom ..... 123/501

*Primary Examiner*—Leonard E. Smith
*Attorney, Agent, or Firm*—Michael J. Striker

[57] ABSTRACT

Fuel injection pump for internal combustion engines with several pump elements located inline, wherein the commencement of injection of each of these pump elements takes place by a control spool axially displaceable on the pump piston and by control of relief ducts provided at the pump working spaces of the pump, the control spools are operated by a torque shaft which is formed in two parts, the first shaft part is axially secured, and the second shaft part is guided so as to be sealed in a bearing bush located in the pump casing. The two shaft parts are pushed one into the other by means of a trunnion and a blind hole which receives the trunnion. The shaft parts are rotationally connected to one another by means of a claw clutch.

12 Claims, 4 Drawing Sheets

FUEL INJECTION PUMP FOR INTERNAL COMBUSTION ENGINES

BACKGROUND OF THE INVENTION

The invention relates to a fuel injection pump for internal combustion engines. In such spool-controlled injection pumps, exact and also synchronous guidance of the control spools is of importance for the injection quality and hence for the combustion quality in the engine. Higher loads on the torque shaft, such as can occur in the case of abrupt twisting, for example, can cause a slight bending of the torque shaft, which not only causes errors in the synchronisation between the individual control spools but can also cause substantially increased friction at the bearings of the torque shaft. Since the twisting of the shaft takes place by means of a governor whose adjustment forces are sensitive and depend on rotational speed, variable frictional forces have particularly disadvantageous effects on the control quality.

As in almost all injection pumps of this type, the bearing of the torque shaft on the drive side in a known injection pump (U.S. Pat. No. 3,667,437) is also designed as a simple sliding bearing which simultaneously forms a type of oil barrier in the direction of the governor.

Apart from these sealing and frictional problems, there are also problems in the manufacture of such bearings because the casing bores for accepting the bearing bushes must be absolutely coaxial with the torque shaft in order to avoid bearing stresses which either lead to intolerable additional frictional forces or to deflections and lack of axial sealing at the bearing when torque is applied.

SUMMARY OF THE INVENTION

It is an object of the invention to provide an improved fuel injection pump.

The fuel injection pump according to the invention has, in contrast to conventional pumps, the advantage that no bending stresses can be transmitted to the bearing because of the cardanic rotational connection between the two shaft parts. The bearing of the second shaft part on the drive side of the torque shaft, in particular, can operate without stress and therefore almost without friction. Because of the absence of transverse forces, the bearing between the second shaft part and the pump casing can be designed with a very fine fit, such as is usual, for example, between injection pump pistons and cylinders, so that there is a substantial sealing against an outflow of fuel from the injection pump into the governor.

According to an advantageous embodiment of the invention, one shaft part has, as an axial guide, an end trunnion extending in the shaft axis on the coupling side, which end trunnion is located in a corresponding blind hole on the end of the other shaft part, it being possible to design this end trunnion so that it is slightly crowned. Distortion-free bearing support of the first shaft part is achieved by this type of the guide for the free end of the first shaft part without slight alignment errors between the two shaft axes having disadvantageous effects in the form of distortions.

According to a further embodiment of the invention, the shaft parts each have an extended section on the ends facing towards one another, for example a collar, on which drive claws or—recesses for the rotational connection are present. This extended section, for example a large collar, to which is added an axial nose which engages in a corresponding recess in the opposite collar, provides a favorable lever arm for the drive without disadvantageous transverse forces.

According to an important embodiment of the invention, the second shaft part is supported in a central bore of a bearing bush which is arranged to seal radially by sealing rings in a pump casing bore and such that an oil ring groove with a leakage hole leading towards the outside is present in the central bore. It is also advantageous to guide the second shaft part in this central bore in the manner of an injection pump element seal. Since there are practically no axial motions of the second shaft part, little fuel will leak between the shaft and the bore if there is a good fit. Even these small quantities, however, are caught by the oil ring groove and deflected so that no diesel fuel from the injection pump reaches the governor, in which it could dilute the lubricating oil present there to an unallowable extent (leakage oil return).

According to a further embodiment of the invention, the free end of the first shaft part runs in a blind hole of a bearing cover inserted in a bore of the pump casing, the bearing section of the first shaft part being designed crowned in this case also. Stress-free twisting of the adjustment shaft is made possible by the crowned design in particular.

In a further embodiment of the invention, there is an annular groove in the section immersed in the blind hole, in which annular groove a securing pin located in the bearing cover or the casing engages to prevent axial displacement of the first shaft part.

Further advantages and advantageous embodiments of the invention may be taken from the following description, the drawing and the claims.

DETAILED DESCRIPTION OF THE PREFERRED EMBODIMENTS

Figure 1:
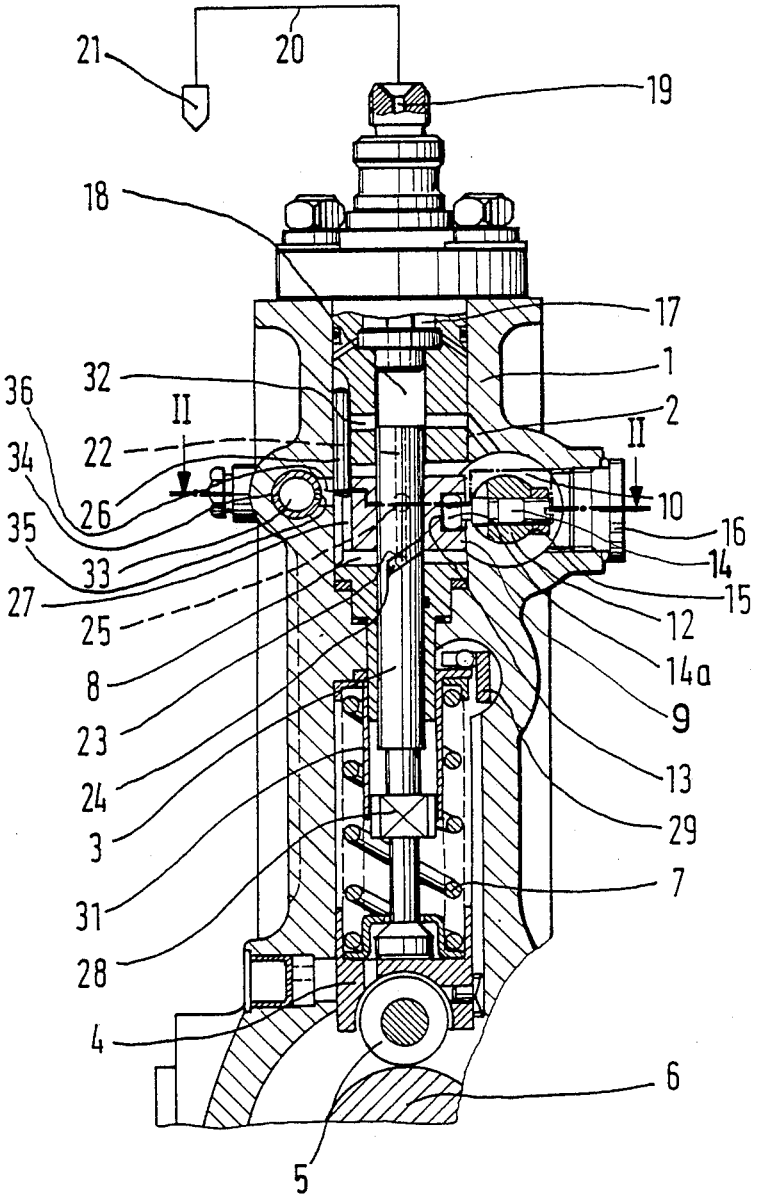
FIG. 1 shows a longitudinal section through a fuel injection pump according to the invention, along the line I—I in FIG. 2.

In the fuel injection pump shown, six cylinder sleeves or bushes or sleeves 2 are inserted in-line in a casing 1; in each of these cylindrical bushes 2, a pump piston 3 is driven, for its axial motion forming the working stroke, via a roller tappet 4 with roller 5 by a camshaft 6 against the force of a spring 7. Partial suction spaces 8, which are each associated with a pump element formed by cylinder sleeve 2 and pump piston 3, are formed by recesses in the cylinder sleeves 2. In these partial suction spaces 8, one control spool or slide 9 is arranged to be axially displaceable on each pump piston 3.

Figure 2:
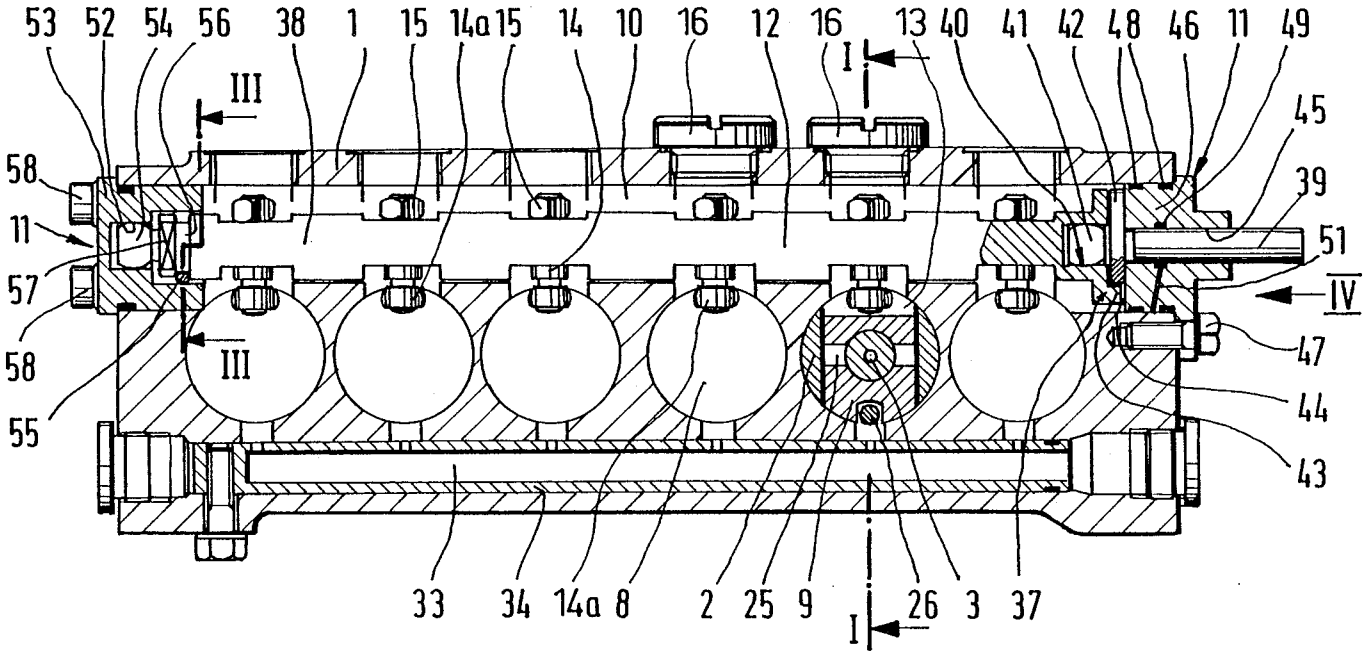
FIG. 2 shows a cross-section through the pump along the line II—II in FIG. 1, only one pump piston and control spool being shown in cross-section.
Figure 4:
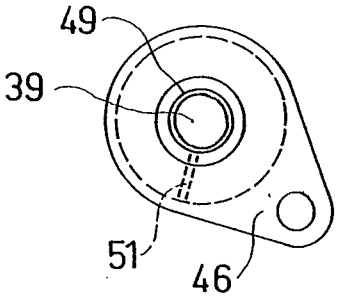
FIGS. 3 and 4 show bearing end plates of the torque shaft, along section III—III in FIG. 2 and according to view IV in FIG. 2, respectively.
Figure 3:
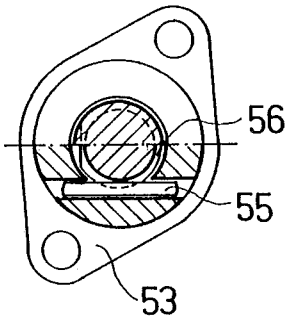
Figure 5:
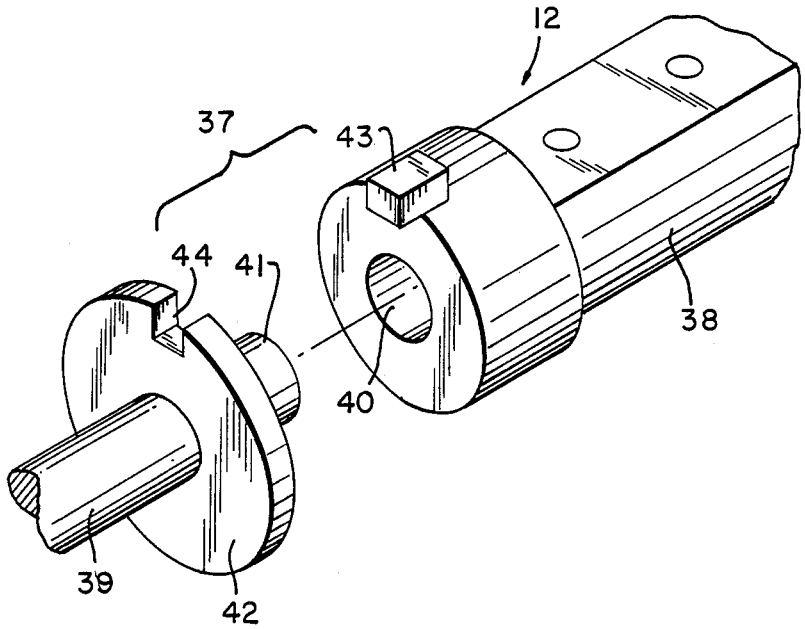
FIG. 5 shows a fragment of FIG. 2 on an enlarged scale.

The individual partial suction spaces 8 merge on the downstream side into a main suction space 10 extending over the length of the casing 1 and which, at its longitudinal ends, is closed by bearing end plates 11 (FIG. 2).

A torque shaft 12, which is supported so that it can be twisted in the bearing end plates 11 and can displace the control spool 9, is located in this main suction space 10. Radially protruding drive trunnions 14*a*, which each engage in a groove 13 of the control spool 9, are positioned in transverse holes of the torque shaft 12 and these drive trunnions 14*a* are each designed as the end section of an eccentric bolt 14 which can be fixed by means of a tensioning nut 15 in its position on the torque shaft 12. A closing stopper 16, of which only two are shown in FIG. 2, is provided opposite each of these tensioning nuts 15 in the casing 1; after these closing stoppers 16 have been removed, adjustment of the individual drive trunnions 14*a* is possible after loosening and retensioning the tensioning nuts 15 in order to adjust the individual control spools 9 relative to one.

The pump piston 3, cylinder sleeves 2 and a pressure valve 17 bound a pump working space 18, from which a pressure duct 19 leads to a pressure line 20, shown simplified, which ends at an injection nozzle 21 of the internal combustion engine. A blind hole 22 merging into the pump working space 18 and a transverse hole 23, which merges into oblique grooves 24 which are machined on the sides facing away from each other in the external surface of the pump piston 3, are provided in the pump piston 3. These oblique grooves 24 interact with radial holes 25 of the contral spool 9 in that they are activated by these radial holes 25 after the pump piston 3 has traversed a certain stroke.

A guide pin 26, which engages in a longitudinal groove 27 of the control spool 9, is located in the cylinder sleeve 2 in order to ensure that the control spool 9 is secured against twisting during its axial displacement on the pump piston 3 and so that exact positioning between the oblique grooves 24 and the radial holes 25 is ensured. The pump piston 3 has, on its lower section, a flat 28 on which engages a drive element 31 which can be rotated in known manner by means of a control rod 29 so that axial displacement of the control rod 29 causes rotation of the pump piston 3 and hence a change in the position of the oblique grooves 24 relative to the radial holes 25.

A suction bore 32, which is opened by the pump piston 3 in its bottom dead center position (as shown in the drawing), is provided in the cylinder sleeve 2.

The fuel supply to the individual partial suction spaces 8 takes place through an inlet flow duct 33 which extends in a tube 34 laid in the casing 1. Radial branch openings 35, which emerge in openings 36 connected to the partial suction spaces 8, are formed in this tube 34.

The torque shaft 12 consists of two shaft parts rotationally connected to one another by means of a claw clutch 37, these being a first shaft part 38 carrying the drive trunnions 14 and a second shaft part 39 engaging with the pump from outside, namely with the governor. The two shaft parts 38 and 39 are axially inserted one into the other, for which purpose a blind hole 40 is provided in the corresponding end of the first shaft part 38 and a slightly convex trunnion 41 entering this blind hole 40 is provided and offers a support to this end of the first shaft part 38. Moreover, the two ends of the shaft parts facing towards each other are extended like flanges so that two collars 42 are opposite to one another. Whereas there is a claw 43 on one collar, there is a corresponding recess 44 on the other roller.

The second shaft part 39 is itself supported in a central bore 45 of a bearing bush 46 which is inserted in the casing bore and forms the bearing end plate 11 and is held by a screw 47. Two annular seals 48 are present between the casing 1 and this bearing bush 46. An oil ring groove 49, from which a relief duct 51 branches off, is located in the central bore 45. This second shaft part 39 is guided in the central bore 45 with very little play such as is provided, for example, for the guidance of pump pistons in cylinders. The fuel possibly leaking through nevertheless from the main suction space 10 is collected by the oil ring groove 49 and is led away by means of the relief duct 51 so that it does not reach the governor casing filled with lubricating oil (leakage oil return).

The other end of the first shaft part 38 is supported in a blind hole 52 of the second bearing end plate 11 designed as a bearing cover 53. The shaft part 38 has, for this purpose, a trunnion 54 which is also crowned in order to exhibit only line contact for the bearing so that slight bending of the shaft part 38 or an installation position, which is not exactly aligned, of the bearing cover 53 does not lead to additional frictional forces.

The axial position of the first shaft part 38 is secured by a pin 55 which engages in an annular groove 56 of the shaft part 38 and is located in the bearing cover 53. A flat 57, which reaches approximately the depth of the annular groove 56, is present on the shaft section between the annular groove 56 and the trunnion 54 for the assembly of the first shaft part 38 in the blind hole 52 of the bearing cover 53. By this means, it is possible to push this free end of the first shaft part 38 into the blind hole 52 at the position of the flat 57 in order subsequently to rotate the shaft part 38 in bayonet fashion so that the pin 55 engages in the annular groove 56. The bearing cover 53 is fastened to the casing by screws 58. The assembly of the torque shaft 12 is undertaken as follows: The first part 38 of the torque shaft is first pushed into the pump casing and rotated, in fact by 90 degrees relative to the operating position. This shaft is then subsequently turned back by the 90 degrees into the working position and is inserted with the drive trunnions 14*a* into the grooves 13 of the control spool 9. The two bearing end plates 11 are then fitted, namely the bearing cover 53 in the manner described by bayonet-type rotation and then the bearing bush 46 with the already installed second shaft part 39.

All the features mentioned in the above descriptions and also those which can only be taken from the drawings are, as further embodiments, constituent parts of the invention even if they are not particulrly emphasized and, in particular, are not mentioned in the claims.

We claim:

1. Fuel injection pump for internal combustion engines comprising a pump casing, several pump elements arranged in-line in the pump casing and driven by a common camshaft, each pump element having a pump piston and a pump cylinder and a pump working space bound by said cylinder and said piston, a plurality of control spools each axially displaceable on each pump piston and controlling at least one control opening formed in an outer surface of the pump piston and connected to a central blind hole formed in the pump piston and open to the pump working space, a suction space surrounding said individual control spools and bounded by said casing and filled with fuel at low pressure flowing through it, a torque shaft provided with adjustable drive trunnions and supported in the pump casing at two ends thereof for a simultaneous operation of all control spools for the beginning and ending of pumping, said torque shaft (12) being divided into a first shaft part

(38) having a free end and rotatably supported at said free end in the pump casing (1) and carrying said drive trunnions (14*a*), and a second shaft part (39) which is rotationally connected to the first shaft part (38) and is supported so as to be sealed in the pump casing (1) and which forms a radial guide (40, 41) for an end of the first shaft part (38) facing towards said second shaft part (39).

2. Fuel injection pump according to claim 1, wherein one of of said shaft parts (39) has an end trunnion (41), said end trunnion (41) extending into a blind hole (40) formed in an end of the other of said shaft parts (38), said end trunnion (41) and said blind hole (40) forming said radial guide.

3. Fuel injection pump according to claim 2, wherein the end trunnion (41) is slightly convex.

4. Fuel injection pump according to claim 1, wherein the first and second shaft parts (38, 39) each have a radially extended section (42) on an end of each shaft part facing towards another shaft part, said extended sections being each provided with means for rotational connection.

5. Fuel injection pump according to claim 4, wherein said rotational connection means includes a drive claw on one of said shaft parts and a drive recess on another of said shaft parts.

6. Fuel injection pump according to claim 1, further including two end plates on said torque shaft, one of said end plates being a bearing bush (46), the second shaft part (39) being supported in a central bore (45) of said bearing bush (46) which carries sealing rings (48) to seal radially said bearing bush in a bore of said casing (3) and said bush having an oil ring groove (49) and a relief duct (51) connected to the central bore (45) of said bush.

7. Fuel injection pump according to claim 6, wherein the second shaft part (39) is guided in the central bore (45) in a sealing manner.

8. Fuel injection pump according to claim 6, wherein another of said end plates is a bearing cover (53), said free end of the first shaft part (38) extending in a blind hole formed in said bearing cover (53) which is inserted in the pump casing (1).

9. Fuel injection pump according to claim 8, wherein said free end of said first shaft part is convex.

10. Fuel injection pump according to claim 9, wherein an annular groove (56) is formed in said free end inserted in the blind hole (52), and a securing pin (55) is inserted in the bearing cover (53), said pin engaging in said groove (56) to prevent an axial displacement of the first shaft part (38).

11. Fuel injection pump according to claim 8, wherein in said free end inserted in the blind hole (52) an annular groove (56) is provided, and a securing pin (55) is provided in the bearing cover (53), said pin engaging in said groove (56) to prevent an axial displacement of the first shaft part (38).

12. Fuel injection pump according to claim 11, wherein said free end has a flat (57) in the vicinity of a bottom of said annular groove so that, after inserting said free end in the blind hole (52) and pushing said flat (57) past the pin (55), an axial anchoring of the first shaft part (38) to the bearing cover (53) takes place by a bayonet-type relative rotation.

* * * * *